United States Patent [19]

Kardux et al.

[11] Patent Number: 4,945,957

[45] Date of Patent: Aug. 7, 1990

[54] HIGH-RESOLUTION WEIGHER/FEEDER FOR FINE PARTICULATE MATERIALS

[75] Inventors: Kenneth A. Kardux, Wayne; Thomas Kristo-Nagy, Clifton, both of N.J.

[73] Assignee: Ohaus Corporation, Florham Park, N.J.

[21] Appl. No.: 393,833

[22] Filed: Aug. 14, 1989

Related U.S. Application Data

[63] Continuation of Ser. No. 189,177, May 2, 1988, abandoned.

[51] Int. Cl.[5] ..... B65D 5/00; G01G 11/00

[52] U.S. Cl. ..... 141/83; 141/128; 222/77; 222/196; 222/55; 177/50; 177/120

[58] Field of Search ..... 141/83, 128, 69, 71; 222/77, 557, 58, 412, 413, 200, 202, 203, 196, 198; 177/50, 116, 119, 120, 121; 198/504, 505, 662, 663, 672, 674

[56] References Cited

U.S. PATENT DOCUMENTS

| | | | |
|---|---|---|---|
| 1,570,795 | 1/1926 | Tainton | 222/202 X |
| 1,593,663 | 7/1926 | Metzger et al. | 222/77 |
| 1,863,964 | 6/1932 | Brenner | 414/468 |
| 2,170,258 | 8/1939 | Borch | 222/202 |
| 2,226,242 | 12/1940 | Harrington | 414/226 |
| 2,549,908 | 4/1951 | Johansen | 177/121 X |
| 2,592,083 | 4/1952 | Vagim | 177/120 |
| 2,732,099 | 1/1956 | Davis | 222/203 |
| 2,754,996 | 7/1956 | Heltzel | 222/77 |
| 2,922,610 | 1/1960 | Bale, Jr. | 177/116 |
| 3,107,743 | 10/1963 | Knobel | 177/116 |
| 3,182,738 | 5/1965 | Frazel | 177/120 |
| 3,186,602 | 6/1965 | Ricciardi | 222/161 |
| 3,191,642 | 6/1965 | Saito | 141/128 |
| 3,259,272 | 7/1966 | Larson | 222/1 |
| 3,329,311 | 7/1967 | Goff et al. | 222/58 X |
| 3,370,758 | 2/1968 | Bodine | 222/196 |
| 3,467,363 | 9/1969 | Reichel | 366/116 |
| 3,506,111 | 4/1970 | Eppenberger | 406/24 |
| 3,540,538 | 11/1970 | Connors et al. | 177/122 |
| 3,637,115 | 1/1972 | Holm | 222/195 |
| 3,812,956 | 5/1974 | Hindermann | 198/575 |
| 3,970,159 | 7/1976 | Haln | 141/128 X |
| 4,057,225 | 11/1977 | Ferree | 222/413 X |
| 4,074,507 | 2/1978 | Ruf et al. | 53/502 |
| 4,095,723 | 6/1978 | Lerner | 222/56 |
| 4,111,272 | 9/1978 | Ricciardi et al. | 177/50 |
| 4,194,844 | 3/1980 | Walling | 366/157 |
| 4,247,019 | 1/1981 | Lerner | 222/56 |
| 4,273,267 | 6/1981 | Conca | 222/412 X |
| 4,275,775 | 6/1981 | Egli | 141/83 |
| 4,346,802 | 8/1982 | Popper | 222/200 X |
| 4,381,545 | 4/1983 | Biddle et al. | 141/128 X |
| 4,453,575 | 6/1984 | Del Rosso | 141/83 |
| 4,569,446 | 2/1986 | Kelley | 209/660 |
| 4,579,252 | 4/1986 | Wilson et al. | 222/55 |
| 4,696,356 | 9/1987 | Ellion et al. | 177/123 |

FOREIGN PATENT DOCUMENTS

| | | | |
|---|---|---|---|
| 321358 | 6/1957 | Switzerland | 222/77 |
| 0777464 | 11/1980 | U.S.S.R. | 222/77 |
| 0932265 | 5/1982 | U.S.S.R. | 177/121 |
| 395235 | 7/1933 | United Kingdom | 177/121 |

*Primary Examiner*—Ernest G. Cusick
*Attorney, Agent, or Firm*—Jeffrey H. Ingerman

[57] ABSTRACT

A highly accurate weighing, feeding and conditioning apparatus for powders and other fine particulate materials is provided. The material is conditioned in a hopper by pulsating inflatable pads within the hopper, or by ultrasonic transmitters mounted on the hopper walls, in apertures in the hopper walls, or on a body at least partially submerged in the fine particulate material. The material is fed by a double auger, one inside the other. In bulk feed mode, both augers rotate at a first, higher speed. In dribble feed mode, only the inner, smaller auger is rotated, at a second, lower speed. This arrangement provides a turn-down ratio of about 500:1. The entire assembly is coupled to a high resolution balance, such as a magnetic force restoration balance, for accurate control of the weight of material fed.

9 Claims, 5 Drawing Sheets

HIGH-RESOLUTION WEIGHER/FEEDER FOR FINE PARTICULATE MATERIALS

This is a continuation, of application Ser. No. 07/189,177, filed May 2, 1988, entitled HIGH-RESOLUTION WEIGHER/FEEDER FOR FINE PARTICULATE MATERIALS, now abandoned.

BACKGROUND OF THE INVENTION

This invention relates to weighing and feeding apparatus for fine particulate materials, such as powders, and particularly to loss-of-weight type weighing apparatus.

Fine particulate materials, such as powders, are frequently fed in industrial processes using hopper-type scales as weighing apparatus, so that a particular weight of material required for a particular process is accurately fed. In the type of scale known as a loss-of-weight scale, a hopper containing the powder is constantly weighed, and the powder is dispensed from the bottom until the amount of weight lost by the scale is the desired weight. In the type of scale known as a net-weight scale, an initially empty hopper is weighed and the powder is fed into it from another hopper (or other feed device) until the initially empty hopper has gained the desired weight. This invention is directed primarily to loss-of-weight feeders, but has application in net-weight feeders as well.

In both types of weighing apparatus, some type of conveyor feeds the powder out of its initial hopper. These conveyors are best suited to meter volume, rather than weight. Because there is always a column of powder falling between hoppers when the conveyor is stopped, the conveyor is stopped before the desired weight is reached to take into account the weight of the falling column. Therefore, it is important to know the density of the powder as it is fed. Because the powder in the hopper is mixed with air, the powder must be "conditioned" in order to assure uniform density. If the conveyor is a screw conveyor, the powder must also be conditioned to keep it flowing in order to prevent "arching"—the formation of an arched void around the screw after an initial quantity has been fed. It is known to condition powders in hoppers by vibrating the hopper, placing an agitator in the hopper, flexing the hopper walls with motor-driven paddles, or mounting an acoustic transmitter in the hopper. However, these methods of conditioning do not offer precise control of the conditioning process.

In order to precisely meter the powder, it is known to provide the conveyor with two feed rates—a higher "bulk" or "full" rate, and a lower "dribble" rate. However, known systems have provided "turn-down" ratios—ratios of bulk rate to dribble rate—of at best about 50:1. With modern weighing apparatus, it is possible to get better resolution than can be taken advantage of with such turn-down ratios.

It would be desirable to be able to provide apparatus for conditioning fine particulate materials in a hopper with better control than has been available.

It would also be desirable to be able to provide a weighing and feeding system for fine particulate materials incorporating high-resolution weighing apparatus.

It would further be desirable to be able to provide such a weighing and feeding system with high-resolution feeding apparatus.

SUMMARY OF THE INVENTION

It is an object of this invention to provide apparatus for conditioning fine particulate materials in a hopper with better control than has been available.

It is also an object of this invention to provide a weighing and feeding system for fine particulate materials incorporating high-resolution weighing apparatus.

It is a further object of this invention to provide such a weighing and feeding system with high-resolution feeding apparatus.

In accordance with this invention, there is provided a hopper for receiving fine particulate material and weighing, conditioning or dispensing that fine particulate material. The hopper has a top and a bottom and includes a plurality of substantially rigid walls defining a volume into which the fine particulate material is introduced. At least one inflatable pad is mounted on each of at least one of the walls within that volume. Means are provided for inflating and deflating the pads in a desired sequence for conditioning the material. Alternatively, an ultrasonic transmitter is mounted in the hopper so that sound waves act either directly or indirectly on the fine particulate material. Feeding means at the bottom of said hopper for feeding the fine particulate material from the hopper have a first volume feed rate and a second volume feed rate, the ratio of the first rate to the second rate being at least about 50:1 and preferably about 500:1. The hopper is coupled to a high-resolution weighing apparatus allowing high-resolution measurement of the weight of material fed.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

A preferred embodiment of the present invention is shown in FIGS. 1–5. The invention is a loss-of-weight feeder including a hopper mounted on a scale understructure. The hopper includes novel conditioning means and novel feeding means for the powder or fine particulate material to be fed.

Figure 1:
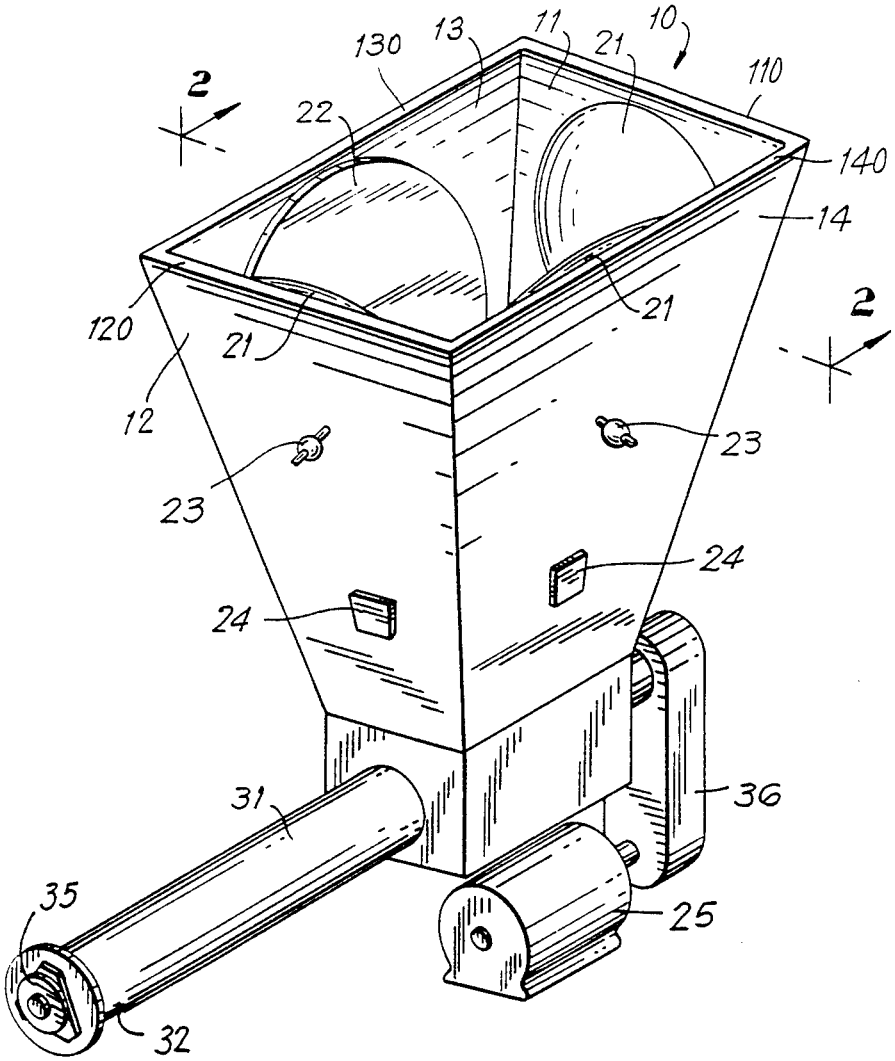
FIG. 1 is a perspective view of a preferred embodiment of a feed hopper having conditioning and feeding means according to this invention.
Figure 2:
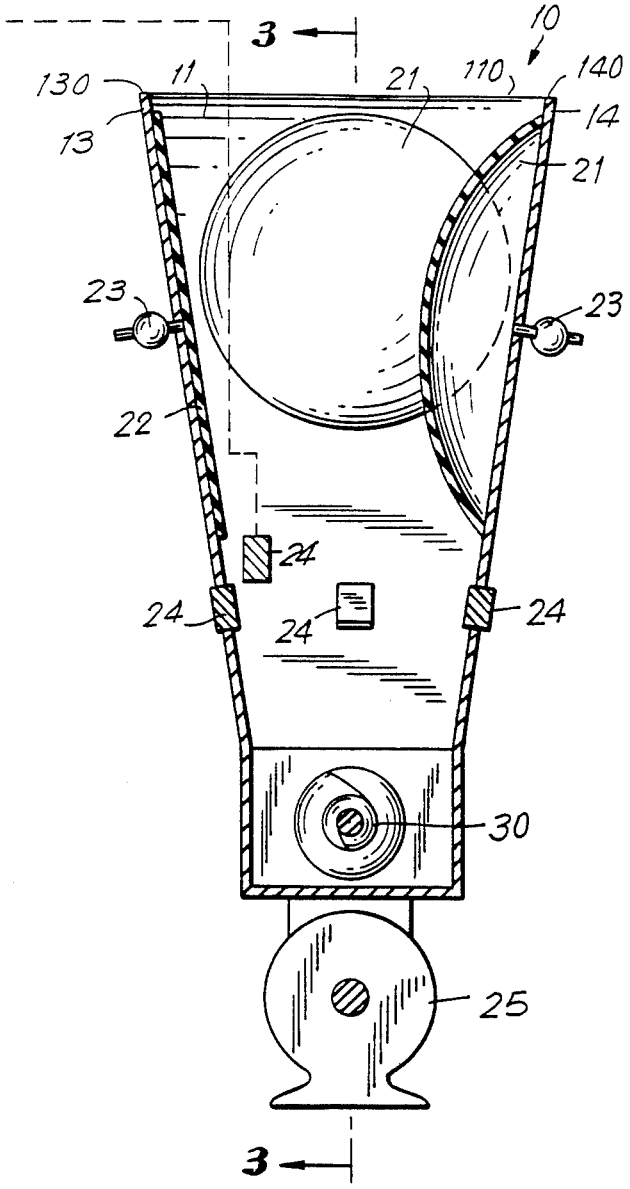
FIG. 2 is a vertical cross-sectional view of the hopper of FIG. 1, taken from line 2—2 of FIG. 1.
Figure 3:
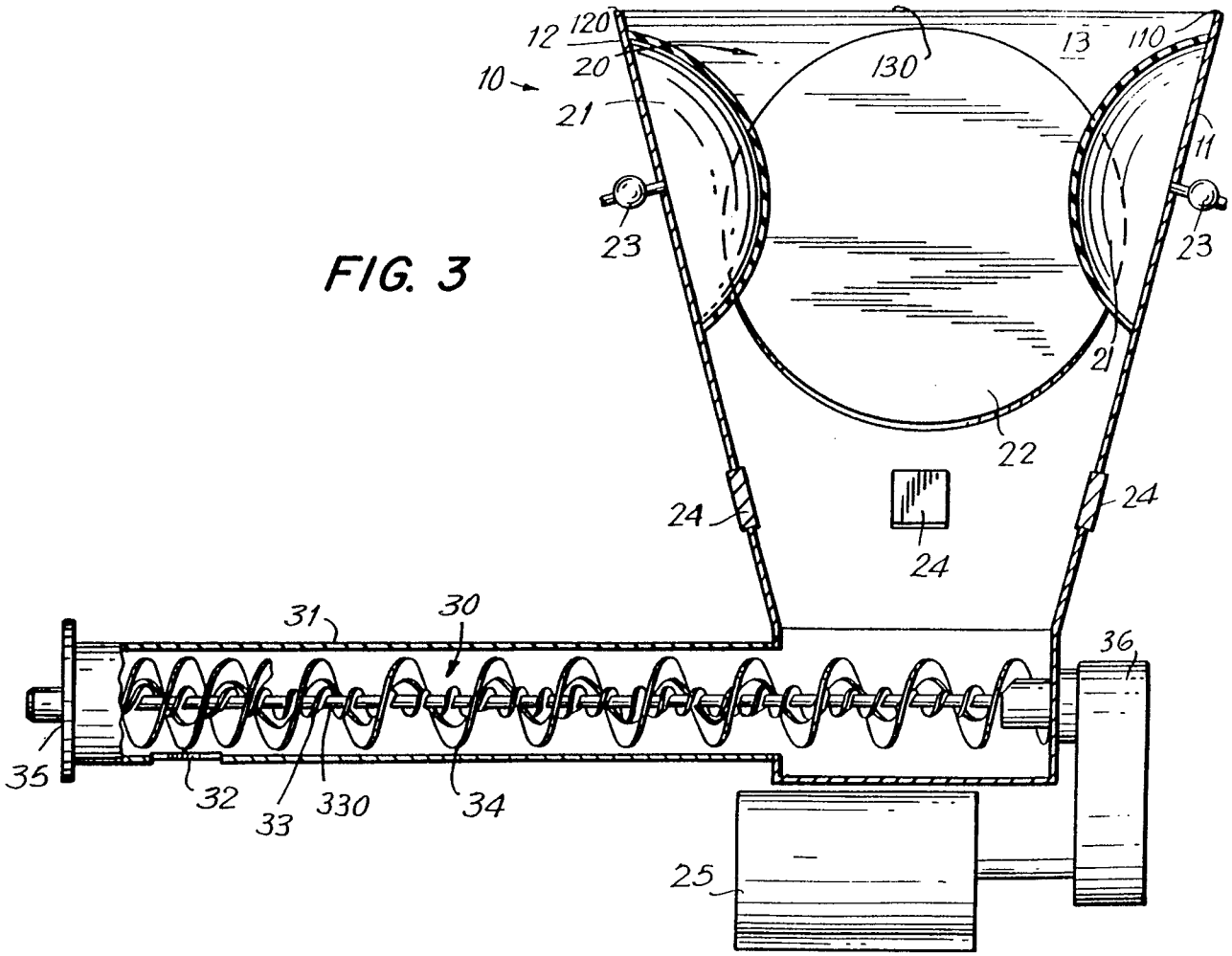
FIG. 3 is a vertical cross-sectional view of the hopper of FIGS. 1–2, taken from line 3—3 of FIG. 2.

The hopper 10 according to the invention is shown in FIGS. 1–3. Hopper 10 has first and second opposing walls 11 and 12, having respective top edges 110, 120. Edges 110, 120 are parallel to one another. Walls 11, 12 are planar or substantially planar—e.g., they could be made up of two or more planar segments (not shown), and are further apart at the top than at the bottom.

Similarly, opposing third and fourth walls 13, 14 have top edges 130, 140 parallel to one another and perpendicular to edges 110, 120, and also are further apart at the top than at the bottom. Hopper 10 thus tapers from a wide mouth 20 at the top to a narrow bottom which is fitted with a dual-auger feeding means 30. Of course, it is not necessary for all four walls to be closer together at the bottom than at the top. For example, walls 11, 12 may be vertical and parallel to one another as long as walls 13, 14 taper toward dual auger 30.

As discussed above, it is desirable to condition the material (not shown) being dispensed from hopper 10 to be sure it is of as uniform a density as possible and, if applicable, that the particles are in as uniform an orientation as possible. In accordance with the present invention, such conditioning can be accomplished using inflatable pads 21 (shown inflated), 22 (shown not inflated) or ultrasonic transmitters 24. If inflatable pads 21, 22 are used, there is preferably one pad 21 mounted on each wall, although fewer pads 21, 22 could be used. Each pad 21, 22 preferably occupies approximately 60% of its respective wall. However, this will vary depending on the properties of the fine particulate material being handled. Pads 21 are fed with compressed air through valves 23. The conditioning process can be controlled by arranging air pulses so that the various pads 21, 22 are inflated at the desired time, which could be the same or could vary according to a predetermined pattern. The pattern could define a "kneading" action which is also influenced by the length of each air pulse and its pressure.

If ultrasonic transmitters 24 are used, at least one transmitter 24 should be provided. Each transmitter 24 could be mounted in an aperture in a respective one of walls 11–14. If transmitters 24 are mounted in an aperture, then the sound waves can act directly on the material. Transmitters 24 could also be mounted on the outer surface of the wall, so that the sound waves emitted would act only on the wall, which would in turn act on the material. It is also possible to mount transmitters 24 on the inner surface of the wall, or on a body which is at least partially submerged into the material in hopper 10, supported by appropriate support means (one such means is shown in phantom in FIG. 2; however, that means is shown for purposes of illustration and not of limitation, and is not intended to exclude any other equivalent means that supports the transmitter at least partially submerged in the material in the hopper). Preferably, sound waves at a frequency of at least about 18 kHz are used.

Dual auger 30 runs in feed tube 31 from the bottom of hopper 10 to a feed opening 32. Although feed tube 31 is shown as horizontal, it could descend vertically (or at an angle) from hopper 10 provided that the material being fed has an angle of repose such that the material does not run out through opening 32 in feed tube 31 when dual auger 30 is stopped, and coarse or fine particulate enough to remain under control when dual auger 30 is operating. Dual auger 30 includes an inner auger 33 of conventional construction, including core 330, and an outer auger 34 which is coreless and is wrapped around inner auger 33. The diameter of each auger and its pitch are determined by the required flow rates and the properties of the material being handled. The ends of augers 33, 34 adjacent opening 32 preferably rotate in a conventional dual bearing 35. The driven ends of augers 33, 34 preferably are driven by variable speed electric motor 25 through a commercially available, electrically operated clutch 36. For full, or bulk, feed, both augers 33, 34 are driven together at a first, higher speed. For dribble feed, outer auger 34 is stopped and inner auger 33 is run at a second, lower speed. The particular speeds are determined by the application, but generally the high speed will be from about 50 RPM to about 300 RPM, while the low speed will be from about 1 RPM to about 50 RPM. In any event the ratio of the high speed to the low speed should be between about 50:1 and about 300:1 to provide a turn-down ratio of at least about 50:1, and preferably about 500:1. The turn-down ratio can exceed the ratio of rotation speeds because the turn-down ratio is also affected by differences in auger diameter and pitch.

Figure 4:
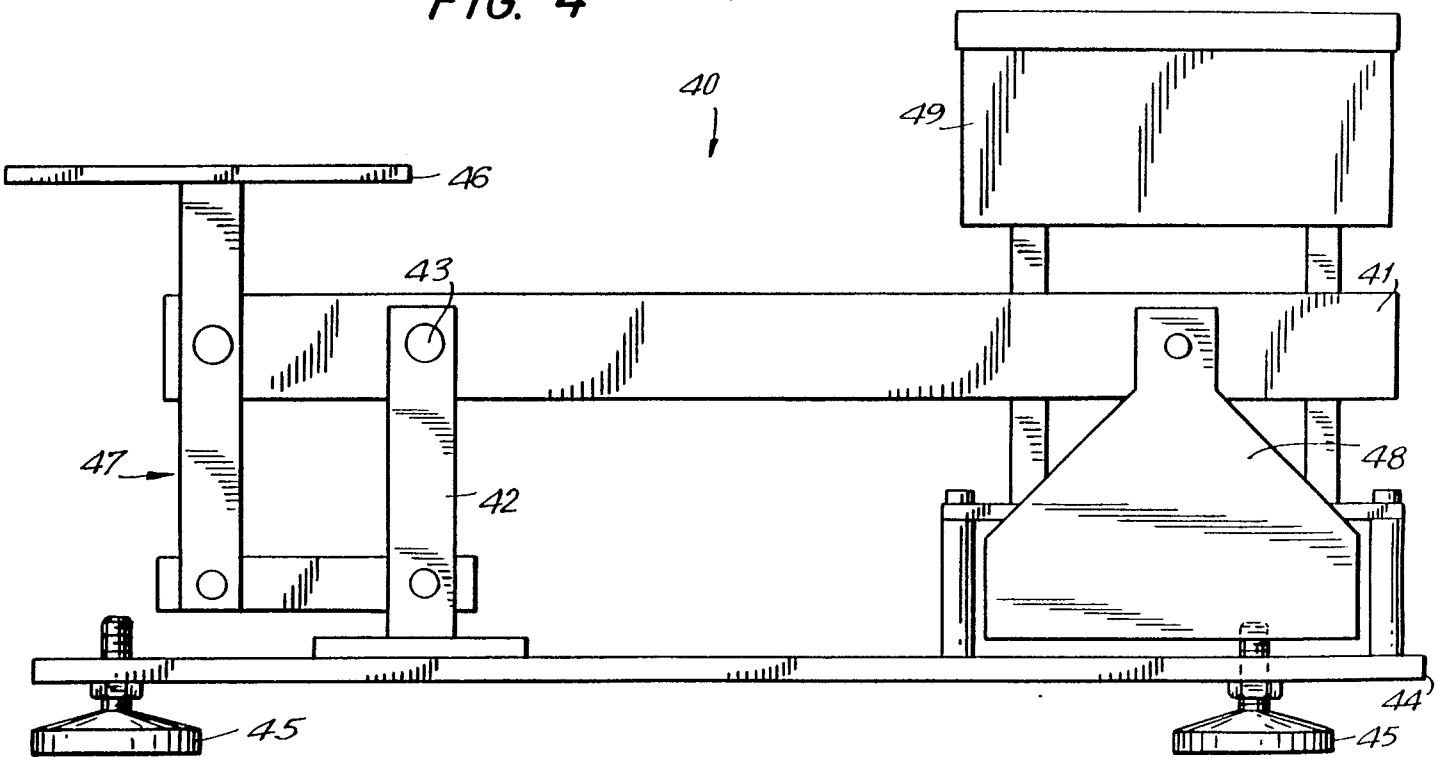
FIG. 4 is an elevational view of a preferred embodiment of a scale understructure on which the hopper of FIGS. 1–3 is mounted in accordance with the invention.
Figure 5:
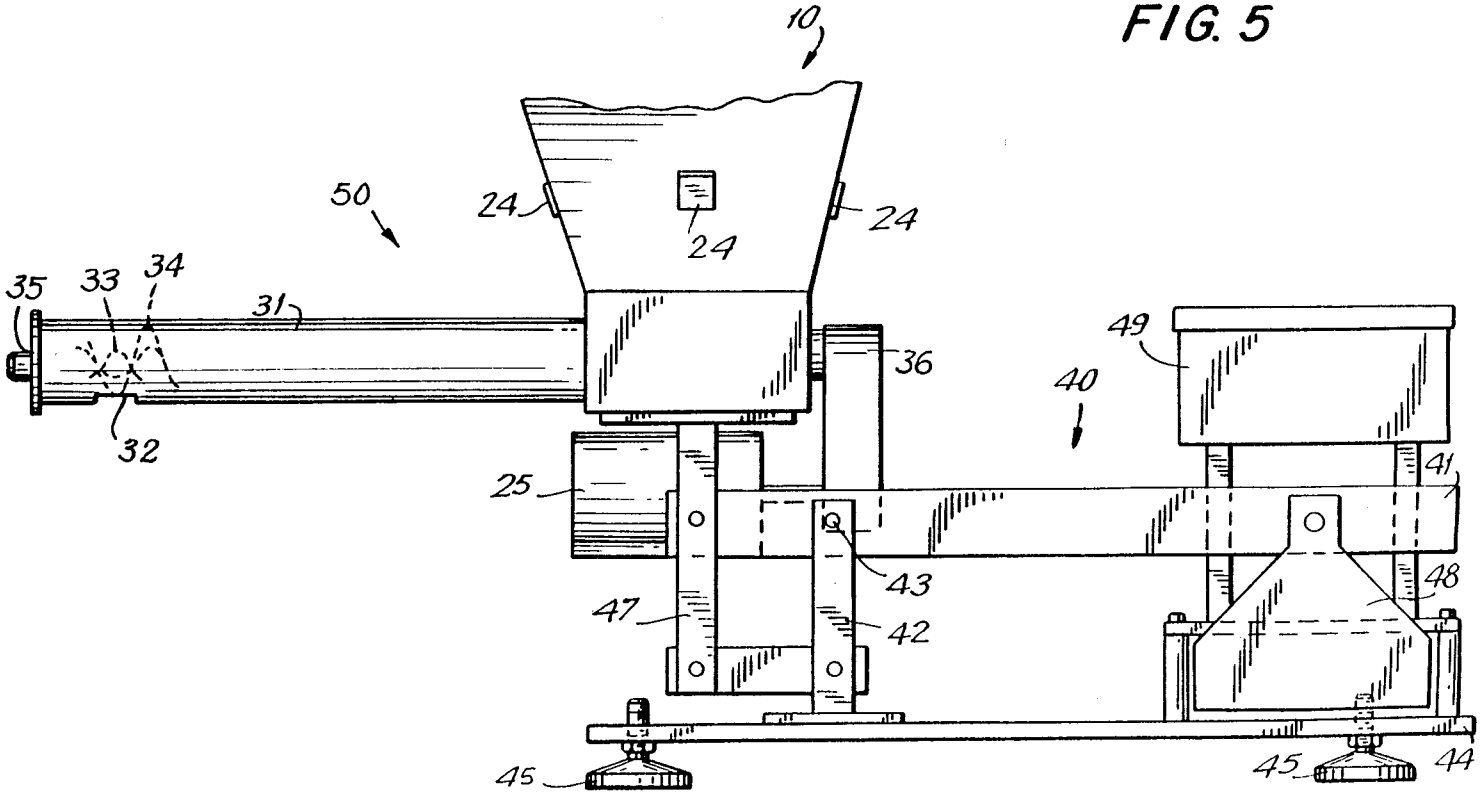
FIG. 5 is an elevational view of the hopper of FIGS. 1–3 mounted on the scale understructure of FIG. 4.

For use as a loss-of-weight feeder, the entire hopper assembly 10, including feed tube 31, motor 25, bearing 35 and clutch 36 is mounted on scale understructure 40, shown in FIG. 4. The combined loss-of-weight feeder 50 is shown in FIG. 5. Scale 40 has a balance beam 41 pivoted on bearing columns 42 (only one of two is shown; the second column is behind the one shown) at 43 using suitable pivot devices. Preferably the pivot devices are frictionless flexures, but other pivot devices such as knife edges could be used. Bearing columns 42 are mounted on a rigid base plate 44, which rests on adjustable leveling pads 45. Assembly 10 rests on load platform 46 which is stabilized by a parallelogram linkage 47. Beam 41 terminates in a high-resolution weight transducer, such as a magnetic force restoration balance transducer 49. A suitable magnetic force restoration balance transducer is the one provided by Ohaus Scale Corporation, of Florham Park, N.J., in its Model GT 8000 balance. At the other end of beam 41, a counterweight 48 is provided to balance the weight of the empty feeder hopper, ratioed to account for the different distances to pivot point 43. Additional counterweights (not shown) are added to balance the weight of material in the hopper when it is full, so that the reduction in weight as material exits hopper 10 is recorded as a positive force.

Hopper assembly 10, with dual augers 33, 34 running with a turn-down ratio of about 500:1, provides very accurate volumetric metering of material from the hopper. With the conditioning pads 21, 22 or tranmitters 24 the density of the material can be accurately controlled. Use of a high-resolution weight transducer such as magnetic force restoration transducer 49 allows precise weight control.

As stated above, the present invention can also be used with net-weight feeders. If so used, hopper 10 would feed the hopper which is being weighed, and that second hopper, in turn, might be weighed by an arrangement such as is shown in FIG. 4.

Thus it is seen that a very accurate weighing, feeding and conditioning apparatus is provided. One skilled in the art will appreciate that the present invention can be practiced by other than the described embodiments, which are presented for purposes of illustration and not of limitation, and the present invention is limited only by the claims which follow.

What is claimed is:

1. A loss-of-weight feeder for weighing and dispensing fine particulate-material, said feeder comprising:

a hopper having a top and a bottom;

an outlet tube extending horizontally from the bottom of said hopper to a feeder outlet;

feeding means at the bottom of said hopper for feeding said fine particulate material from said hopper at a first feed rate and a second feed rate, the ratio of said first rate to said second rate being about 500:1, said feeding means comprising first and second screw conveyors for conveying said fine particulate material horizontally through said outlet tube, one of said screw conveyors being a high-volume screw conveyor capable of running at a high volume rate, and the other of said screw conveyors being a low-volume screw conveyor capable of running at both a high volume rate and a low volume rate, said low-volume conveyor being an auger capable of a high rate of rotation and a low rate of rotation, and said high-volume conveyor being a coreless auger wrapped around said low-volume conveyor, said high-volume conveyor being capable of said high rate of rotation, both of said augers having the same length, the ratio of said high rate of rotation to said low rate of rotation being about 300:1, said feeding means feeding said fine particulate material from said hopper at said first feed rate until a desired weight of material to be fed is approached at which time said feeding means feeds said fine particulate material from said hopper at said second feed rate until said desired weight is reached; and high-resolution weighing means, said hopper being coupled to said weighing means, said weighing means allowing high-resolution measurement of the weight of material fed; whereby:

said feeder provides highly accurate control of the weight of material fed.

2. The feeder of claim 1 wherein said high-resolution weighing means comprises a magnetic force restoration balance.

3. The feeder of claim 1 wherein said hopper comprises:

first and second walls having top edges parallel to one another and bottom edges parallel to one another, and third and fourth walls having top edges parallel to one another and bottom edges parallel to one another, said edges of said third and fourth walls being perpendicular to said edges of said first and second walls, at least one pair from among said first and second walls, and said third and fourth walls, respectively, being closer together at the bottom than at the top such that said hopper has a substantially V-shaped vertical cross section in at least one of two orthogonal directions; and means for conditioning said fine particulate material.

4. The feeder of claim 3 wherein said conditioning means comprises:

at least one inflatable pad mounted on each of at least one of said walls within said hopper; and means for inflating and deflating said at least one pad in a desired sequence for conditioning said fine particulate material in said hopper.

5. The feeder of claim 4 comprising four of said inflatable pads, one on each of said four walls.

6. The feeder of claim 3 wherein said conditioning means comprises at least one ultrasonic transmitter for generating ultrasonic waves for conditioning said fine particulate material in said volume.

7. The feeder of claim 6 wherein said at least one ultrasonic transmiter is mounted on at least one of said walls.

8. The feeder of claim 7 wherein said transmitter is mounted such that said ultrasonic waves act directly on said material without passing through said walls.

9. The feeder of claim 6 further comprising a body at least partially submerged is said fine particulate material, at least one ultrasonic transmitter being mounted on said body.

* * * * *